US009437998B2

(12) United States Patent
Chen et al.

(10) Patent No.: US 9,437,998 B2
(45) **Date of Patent: *Sep. 6, 2016**

(54) METHOD OF PREPARING SILVER-BASED ELECTRICAL CONTACT MATERIALS WITH DIRECTIONALLY ARRANGED REINFORCING PARTICLES

(75) Inventors: Lesheng Chen, Yueqing (CN); Xiao Chen, Yueqing (CN); Chengfa Mu, Yueqing (CN); Gengxin Qi, Yueqing (CN)

(73) Assignee: Wenzhou Hongfeng Electrical Alloy Co., Ltd., Yueqing, Zhejiang (CN)

( * ) Notice: Subject to any disclaimer, the term of this patent is extended or adjusted under 35 U.S.C. 154(b) by 328 days.

This patent is subject to a terminal disclaimer.

(21) Appl. No.: 13/578,378

(22) PCT Filed: Apr. 11, 2011

(86) PCT No.: PCT/CN2011/000631

§ 371 (c)(1),
(2), (4) Date: Aug. 10, 2012

(87) PCT Pub. No.: WO2012/075667

PCT Pub. Date: Jun. 14, 2012

(65) Prior Publication Data

US 2013/0277894 A1 Oct. 24, 2013

(30) Foreign Application Priority Data

Dec. 9, 2010 (CN) ..... 2010 1 0579827

(51) Int. Cl.
*H01R 43/16* (2006.01)
*B22F 1/02* (2006.01)
(Continued)

(52) U.S. Cl.
CPC ..... *H01R 43/16* (2013.01); *B22F 1/025* (2013.01); *B22F 3/162* (2013.01); *B22F 3/20* (2013.01); *B22F 9/24* (2013.01); *C22C 5/06* (2013.01); *H01B 1/02* (2013.01); *B22F 2998/10* (2013.01)

(58) Field of Classification Search
CPC ..... H01R 43/16; B22F 9/24; B22F 3/162; B22F 1/025; B22F 3/20; B22F 2998/10; H01B 1/02; C22C 5/06
USPC ..... 264/614, 603, 176.1; 427/217; 419/21, 419/28, 32, 33, 38, 42, 48
See application file for complete search history.

(56) References Cited

U.S. PATENT DOCUMENTS 3,501,287 A * 3/1970 Lever ..... C22C 32/0021 419/19
3,502,509 A * 3/1970 Sindorf ..... 502/101
(Continued)

*Primary Examiner* — Nahida Sultana

(57) ABSTRACT

A method of preparing silver-based electrical contact materials with directionally arranged reinforcing particles includes steps of: (1) preparing composite powders with Ag coating on the reinforcing phase by chemical plating coating; (2) granulating; (3) placing the granulated powders and the matrix silver powders into the powder mixer for mixing; (4) cold-isostatically pressing; (5) sintering; (6) hot-pressing; (7) hot-extruding, thereby obtaining the reinforcing silver-based electrical contact materials with directionally arranged particles. Regardless of the size of reinforcing particles, the present invention can obtain particle-reinforced silver-based materials with excellent electrical performance. The process is simple and easy to operate, and places no special requirements on the equipment. Furthermore, the resistance to welding and arc erosion, and the conductivity of the material prepared by the present invention can be greatly improved. Moreover, the processing performance is excellent.

8 Claims, 1 Drawing Sheet

(51) Int. Cl.

| | |
|---|---|
| ***B22F 3/16*** | (2006.01) |
| ***B22F 3/20*** | (2006.01) |
| ***B22F 9/24*** | (2006.01) |
| ***C22C 5/06*** | (2006.01) |
| ***H01B 1/02*** | (2006.01) |

(56) References Cited

U.S. PATENT DOCUMENTS 4,018,630 A * 4/1977 Hill ..... H01H 1/0237 148/430
4,609,525 A * 9/1986 Schreiner ..... H01H 1/02372 419/19
4,776,883 A * 10/1988 Hayashi et al. ..... 75/365
5,360,673 A * 11/1994 Mayer ..... B22F 1/0003 419/19
5,846,288 A * 12/1998 Jost et al. ..... 75/252
6,387,542 B1 * 5/2002 Kozlov et al. ..... 428/673
6,409,794 B2 * 6/2002 Wolmer ..... B22F 9/04 419/28
6,605,751 B1 * 8/2003 Gibbins ..... A61K 9/70 602/41
7,566,437 B2 * 7/2009 Goia ..... B22F 9/04 252/500
2001/0051102 A1 * 12/2001 Wolmer et al. ..... 419/21
2003/0170314 A1 * 9/2003 Burrell ..... A61K 8/19 424/618
2004/0086728 A1 * 5/2004 Maruoka et al. ..... 428/447
2004/0129112 A1 * 7/2004 Gillis ..... A61K 8/19 75/252
2006/0260720 A1 * 11/2006 Martorana ..... B22F 1/004 148/430
2008/0241543 A1 * 10/2008 Kempf ..... B82Y 30/00 428/403
2008/0299160 A1 * 12/2008 Agboh ..... A61L 15/18 424/405
2011/0008407 A1 * 1/2011 Gan ..... A61L 27/32 424/423
2012/0177713 A1 * 7/2012 Weiss et al. ..... 424/405
2013/0058826 A1 * 3/2013 Irizarry et al. ..... 420/501

* cited by examiner

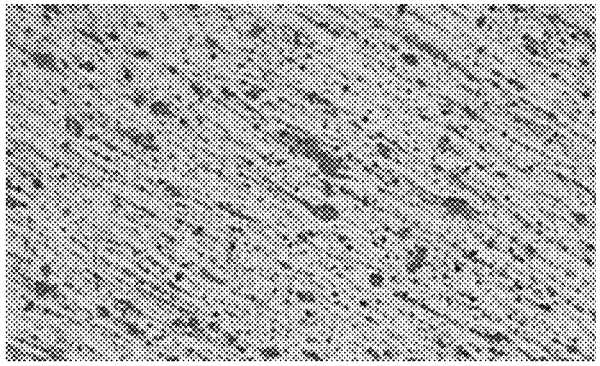

METHOD OF PREPARING SILVER-BASED ELECTRICAL CONTACT MATERIALS WITH DIRECTIONALLY ARRANGED REINFORCING PARTICLES

CROSS REFERENCE OF RELATED APPLICATION

This is a U.S. National Stage under 35 USC 371 of the International Application PCT/CN2011/000631, filed 11 Apr. 2011.

BACKGROUND OF THE PRESENT INVENTION

1. Field of Invention

The present invention relates to a preparation method of the electrical contact materials in material technology field, and more particularly to a preparation method of the silver based electrical contact materials reinforced by directionally arranged particles.

2. Description of Related Arts

With the development of modern industry, there seems to be an increasingly high requirement on the performance of the silver-based electrical contact materials. Therefore, a silver-matrix composite intended for better electrical and mechanical performance has been developed to replace the outdated traditional silver-based contact materials. In recent years, particle reinforced silver-based contact materials with excellent electrical and physicochemical properties are widely researched and applied. As the reinforcement of the silver based composite, directionally arranged reinforcing particles could be achieved at low cost and through a relatively simple preparation process such as the traditional metal working process, and thus there is a prospective outlook on the development of this composite. After retrieval, the research reports on the particle reinforced silver-based electrical contact materials at home and abroad are described as follows.

1) Chinese invention patent: a preparation method of carbon coated nickel nano-particle reinforced silver-based composite material, Application No. 200810153154.9, Publication No. CN101403105A 2) Chinese invention patent: a preparation method of tin oxide reinforced silver-based electrical contact material, Application No. 200910196280.7, Publication No. CN101707155A 3) Chinese invention patent: a preparation method of metal matrix composites, application number: 200410064970.4, publication number: CN1760399A 4) Chinese invention patent: a preparation method of particle reinforcing metal matrix composites, application number: 200810018200.4, publication number: CN101285187A.

At present, there are two preparation methods of particle reinforced silver-based electrical contact materials. The first method is the traditional powder metallurgy and sintering technique, by means of which the reinforcing particles and the matrix metal powders are uniformly mixed, pressed, sintered, extruded, rolled and forged for further processing. Through the powder mixing, the reinforcing particles are easily agglomerated and unevenly distributed, thereby affecting the performance of the obtained products. The second method is based on the traditional method of pre-processing the reinforcing particles [1], the reinforcing particles—the matrix [2 and 3], or the matrix [4] by special technologies. Through the second method, the reinforcing particles can be dispersedly distributed in the silver matrix by pre-processing the particles. However, research has shown that when the size of the dispersedly distributed reinforcing particles is small (nano-level), the electronic dispersion effect will be greatly enhanced and the electrical resistance of the contact materials will increase significantly, thereby seriously affecting the performance of the products.

SUMMARY OF THE PRESENT INVENTION

With regard to the shortcomings and defects of the prior art, the present invention provides a method of preparing silver-based electrical contact materials with directionally arranged reinforcing particles, which can obtain the particle-reinforced silver-based materials with excellent electrical performance regardless of the size of reinforcing particles. The process is simple, easy to operate, and places no special requirements on the equipment. Furthermore, the resistance to welding and arc erosion, and the conductivity of the materials prepared by the present invention are greatly improved, and the processing performance is excellent.

To accomplish the above object, the technical solution adopted by the present invention is described as follows.

The present invention provides a method of preparing silver-based electrical contact materials with directionally arranged reinforcing particles, comprising steps of:

(A) dissolving reinforcing powders in hydrazine hydrate solution, adding the mixed solution into $AgNO_3$ solution for stirring, and simultaneously adding ammonia to adjust a PH value of the solution, filtering out the precipitation after reaction, and then washing and drying the filtered precipitation, thereby obtaining composite powders with Ag-coated reinforcing particles, wherein the weight ratio of the reinforcing phase to $AgNO_3$ is calculated according to the content of the material, and the weight ratio of the hydrazine hydrate to $AgNO_3$ is calculated according to Ag ion reduced by the hydrazine hydrate;

(B) sintering and granulating the composite powders obtained from step (A);

(C) placing the powders obtained from step (B) and the matrix silver powders into a powder mixer for mixing, wherein the weight ratio of the composite powders to the matrix silver powders is calculated according to the content of the required materials;

(D) cold-isostatically pressing the powders obtained from step (C);

(E) sintering the cold-isostatically pressed body;

(F) hot-pressing the sintered body; and (G) hot-extruding the hot-pressed body to obtain the silver-based electrical contact material with directionally arranged reinforcing particles.

For the silver-based electrical contract material with directionally arranged reinforcing particles prepared by the present invention, the reinforcing phase exists in the matrix in a form of particles connecting with each other and directionally arranged. The average size of the particles of the reinforcing powders is 5 nm-30 μm, and the reinforcing phase is one kind of material or a mixture of a variety of materials.

The traditional preparation method combines chemical plating with powder metallurgy (namely, preparing the composite powders by chemical plating coating→mixing the composite powders with the matrix powders (or composite powders)→cold-pressing→sintering→repressing→extruding). In the method of the present invention, the coated body, that is, Ag coating on the reinforcing particles, is prepared by chemical plating. The aggregated body of the coated body is obtained by granulating. Then the aggregated body and the matrix Ag powders are uniformly mixed according to the required ratio of the material composition formula, and then cold-isostatically pressed, sintered, hot-pressed and hot-extruded. During the extrusion process, the coated body flows with the softened Ag in the Ag matrix. With coating of Ag, the reinforcing particles are easily open, and directionally arranged along the extrusion direction forming the fibrous structure. The materials prepared by this method have the reinforcing particles with fiber-like arrangement connecting with each other and being directionally arranged. The resistance to arc erosion of the materials prepared by this method increases by 10-20% compared with the contact materials with reinforcing particles dispersing in the same material system. Electrical conductivity along the extrusion direction increases by 5-15%; welding resistance increases by 10-20% and electrical service life increases by 10-30%. Furthermore, it has excellent processing performance for large-scale production.

BRIEF DESCRIPTION OF THE DRAWINGS

The drawing is the metallograph of the $AgSnO_2$(10) electrical contact material with directionally arranged reinforcing particles prepared by the first embodiment of this invention.

DETAILED DESCRIPTION OF THE PREFERRED EMBODIMENT

A description of the technical solution of the present invention is presented as follows for a better understanding of the present invention. While the following instructions are only to clarify the technical solution of the present invention with no limitation to the scope of the invention, the scope of protection of the present invention is subject to claims.

The preparation method of the above-mentioned silver-based electrical contact material with directionally arranged reinforcing particles of the present invention is adapted for the ordinary particle-reinforced silver-based composites. Regardless of the size of reinforcing particles, the particle-reinforced silver-based materials have excellent electrical performance. The process is simple, easy to operate, and places no special requirements on the equipment. Furthermore, the resistance to welding and arc erosion resistance and the conductivity of the material prepared by the present invention are greatly improved, and the processing performance is excellent.

For the silver-based electrical contact material prepared by the present invention, the reinforcing phase exists in the matrix in the form of the particles connecting with each other and being directionally arranged. The average size of the reinforcing particles is 5 nm-30 μm. The reinforcing material can be a single kind of materials or a mixture of a variety of materials. The reinforcing phase is determined according to the content of the material needed.

In the present invention, specific process operation parameters of steps such as ball milling, powder mixing, cold isostatic pressing, sintering, hot pressing and hot extruding can be altered. One preferred parameter is stated as below:

In the $1^{st}$ step, the reinforcing powders are dissolved in the hydrazine hydrate solution, and then the mixed solution is added into the $AgNO_3$ aqueous solution for stirring, and simultaneously ammonia is added for adjusting PH value. After the reaction, the precipitation is filtered out, and then washed and dried in turn, thereby obtaining the composite powders with Ag coated reinforcing phase. The following parameters can be used. The weight ratio of the reinforcing powders to $AgNO_3$ is between 1/4 and 10/3. The weight ratio of hydrazine hydrate to $AgNO_3$ is between 2/3 and 1/3. The stirring speed is between 80 rev/min and 120 rev/min. The PH value is between 8 and 11. The reaction time is between 3 hours and 10 hours. The drying temperature is between 40° C. and 100° C., and the drying time is between 3 hours and 10 hours.

In the $2^{nd}$ step, the composite powders obtained from the $1^{st}$ step is sintered and granulated. The parameters can be set as below. The sintering temperature is between 400° C. and 800° C. and the sintering time is between 2 hours and 6 hours.

In the $3^{rd}$ step, the composite powders obtained from the $2^{nd}$ step and silver powders are placed into the powder mixer for mixing. The weight ratio of the composite powders and the matrix silver powders is calculated according to the content of the preparation material needed. The parameters can be set as below. The speed of the powder mixer is between 20 rev/min and 30 rev/min, and the mixing time is between 2 hours and 4 hours.

In the $4^{th}$ step, the powders obtained from the $3^{rd}$ step are cold-isostatically pressed. The parameters can be set as below. The pressure is between 100 MPa and 500 MPa.

In the $5^{th}$ step, the body obtained from the $4^{th}$ step is sintered. The parameters can be set as below. The sintering temperature is between 600° C. and 800° C., and the sintering time is between 5 hours and 9 hours.

In the $6^{th}$ step, the sintered body is hot-pressed. The parameters can be set as below. The hot pressing temperature is between 500° C. and 800° C., the hot pressing pressure is between 300 MPa and 700 MPa, and the hot pressing time is between 1 min and 20 min.

In the $7^{th}$ step, the hot-pressed body is hot-extruded, thereby obtaining the silver-based electrical contact material with fiber-like arrangement. The parameters can be set as below. The heating temperature of the body is between 600° C. and 900° C., the extruding ratio is between 100 and 400, the extruding speed is between 5 cm/min and 20 cm/min, and the preheating temperature of the extrusion mold is between 300° C. and 500° C.

The detailed technical operations of the present invention are illustrated with the following specific embodiments.

Embodiment 1

Take the preparation of $AgSnO_2$(10) contact material as an example (see the drawing).

Step 1: 300 g reinforcing $SnO_2$ powders (with an average particle size of 5 nm) are dissolved in 10 L aqueous solution containing 800 g hydrazine hydrate, and then the mixed solution is added into 15 L aqueous solution containing 1200 g $AgNO_3$ with a stirring speed of 120 rev/min, and simultaneously ammonia is added to adjust the PH value of the solution to be 8 with the reaction time of 10 hours. The precipitation is filtered out, washed and dried at the drying temperature of 100° C. for 5 hours, thereby obtaining the composite powders with Ag coated reinforcing phase.

Step 2: The composite powders obtained from Step 1 is granulated. The parameters can be set as below. The sintering temperature is 800° C. and the sintering time is 2 hours.

Step 3: The composite powders obtained from Step 2 is weighed, and the matrix silver powders are added into the composite powders according to the weight ratio which is 10% of $SnO_2$ to the total weight, and then placed into the V-shaped powder mixer for uniformly mixing. The mixing speed is 30 rev/min and the time is 4 hours.

Step 4: The powders obtained from Step 3 is placed into a plastic tube with a diameter of 90 cm and a length of 150 cm for cold-isostatical pressing. The cold isostatic pressure is 100 MPa.

Step 5: The cold-isostatically pressed body obtained from Step 4 is sintered. The sintering temperature is 800° C., and the sintering time is 5 hours.

Step 6: The sintered body obtained from Step 5 is hot-pressed. The hot pressing temperature is 800° C., the hot pressing pressure is 500 MPa, and the hot pressing time is 10 min.

Step 7: The hot-pressed body is hot-extruded. The hot extruding temperature is 900° C., the extruding ratio is 225, the extruding speed is 5 cm/min, and the preheating temperature of the extrusion mold is 500° C.

In this embodiment, the $AgSnO_2$(10) material with neat $SnO_2$ reinforced fiber-like arrangement is finally obtained. The $SnO_2$ fiber-like arrangement is in the form of a number of directionally arranged and interconnected $SnO_2$ nano-particles. Its metallographic photograph is shown in the drawing. The obtained materials have the tensile strength of 280 MPa, the resistivity along the extrusion direction of 2.1 μΩ·m and the hardness of 83 HV.

Embodiment 2

Take the preparation of AgZnO(8) contact material as an example.

Step 1: 300 g reinforcing phase ZnO powders (with an average particle size of 500 nm) are dissolved in 5 L aqueous solution containing 60 g hydrazine hydrate, and then the mixed solution is added into 10 L aqueous solution containing 150 g $AgNO_3$ with a stirring speed of 100 rev/min, and simultaneously ammonia is added to adjust the PH value of the solution to be 10 with the reaction time of 5 hours. The precipitation is filtered out, washed and dried at the drying temperature of 80° C. for 6 hours, thereby obtaining the composite powders with Ag coated reinforcing phase.

Step 2: The composite powders obtained from Step 1 is granulated. The parameters can be set as below. The sintering temperature is 600° C. and the sintering time is 4 hours.

Step 3: The composite powders obtained from Step 2 is weighed, and the matrix silver powders are added into the composite powders according to the weight ratio which is 8% of ZnO to the total weight, and then placed into the V-shaped powder mixer for uniformly mixing. The mixing speed is 30 rev/min and the time is 3 hours.

Step 4: The powders obtained from Step 3 is placed into a plastic tube with a diameter of 90 cm and a length of 150 cm for cold-isostatical pressing. The cold isostatic pressure is 100 MPa.

Step 5: The cold-isostatically pressed body obtained from Step 4 is sintered. The sintering temperature is 600° C., and the sintering time is 8 hours.

Step 6: The sintered body obtained from Step 5 is hot-pressed. The hot pressing temperature is 800° C., the hot pressing pressure is 700 MPa, and the hot pressing time is 1 min Step 7: The hot-pressed body is hot-extruded. The hot extruding temperature is 600° C., the extruding ratio is 324, the extruding speed is 8 cm/min, and the preheating temperature of the extrusion mold is 300° C.

In this embodiment, the AgZnO(8) material with neat ZnO reinforced fiber-like arrangement is finally obtained. The ZnO fiber-like arrangement is in the form of a number of directionally arranged and connected ZnO nano-particles. The obtained material has the tensile strength of 288 MPa, the resistivity along the extrusion direction of 2.0 μΩ·m and the hardness of 85 HV.

Embodiment 3

Take the preparation of AgCdO12 contact material as an example

Step 1: 300 g reinforcing phase CdO powders (with an average particle size of 100 nm) are dissolved in 5 L aqueous solution containing 30 g hydrazine hydrate, and then the mixed solution is added into 15 L aqueous solution containing 90 g $AgNO_3$ with a stirring speed of 80 rev/min, and simultaneously ammonia is added to adjust the PH value of the solution to be 9 with the reaction time of 3 hours, the precipitation is filtered out, washed and dried at the drying temperature of 40° C. for 10 hours, thereby obtaining the composite powders with Ag coated reinforcing phase.

Step 2: The composite powders obtained from the $1^{st}$ step is granulated. The parameters can be set as below. The sintering temperature is 400° C. and the sintering time is 6 hours.

Step 3: The composite powders obtained from the $2^{nd}$ step are weighed, and the matrix silver powders are added into the composite powders according to the weight ratio 12% of CdO to the total weight, and then placed into the V-shaped powder mixer for uniformly mixing. The speed of the mixing machine is 30 rev/min and the time is 4 hours.

Step 4: The powders obtained from the $3^{th}$ step is placed into a plastic tube with a diameter of 90 cm and a length of 150 cm for cold-isostatical pressing. The cold isostatic pressure is 300 MPa.

Step 5: The cold-isostatically pressed body obtained from the $4^{th}$ step is sintered. The sintering temperature is 750° C., and the sintering time is 9 hours.

Step 6: The sintered body obtained from the 5th step is hot-pressed. The hot pressing temperature is 800° C., the hot pressing pressure is 700 MPa, and the hot pressing time is 20 min.

Step 7: The hot-pressed body is hot-extruded into sheets. The hot extruding temperature is 800° C., the extruding ratio is 100, the extruding speed is 20 cm/min, and the preheating temperature of the extrusion mold is 300° C.

In this embodiment, the AgCdO12 material with neat CdO reinforced fiber-like arrangement is finally obtained. The CdO fiber-like arrangement is in the form of a number of directionally arranged and connected small CdO particles. The obtained material has the tensile strength of 285 MPa, the resistivity along the extrusion direction of 2.0 μΩ·m and the hardness of 88 HV.

Embodiment 4

Take the preparation of Ag-4ZnO-8$SnO_2$ contact material for example

Step 1: 300 g reinforcing ZnO—$SnO_2$ powders (with weight ratio of ZnO to $SnO_2$ in the ZnO—$SnO_2$ material being 0.5 and an average particle size of 300 nm) are dissolved in 8 L aqueous solution containing 400 g hydrazine hydrate, and then the mixed solution is added into 12 L aqueous solution containing 1200 g $AgNO_3$ with a stirring speed of 80 rev/min, and simultaneously ammonia is added to adjust the PH value of the solution to be 9 with the reaction time of 8 hours, the precipitation is filtered out, washed and dried at the drying temperature of 80° C. for 3 hours, thereby obtaining the composite powders with Ag coating the reinforcing phase.

Step 2: The composite powders obtained from the $1^{st}$ step is granulated. The parameters can be set as below. The sintering temperature is 800° C. and the sintering time is 2 hours.

Step 3: The composite powders obtained from the $2^{nd}$ step are weighed, and the matrix silver powders are added into the composite powders according to the weight ratio 12% of ZnO—$SnO_2$ to the total weight, and then placed into the V-shaped powder mixer for uniformly mixing. The speed of the mixing machine is 20 rev/min and the time is 4 hours.

Step 4: The powders obtained from the $3^{rd}$ step are placed into a plastic tube with a diameter of 90 cm and a length of 150 cm for cold-isostatically pressing. The cold isostatic pressure is 500 MPa.

Step 5: The cold-isostatically pressed body obtained from the $4^{th}$ step is sintered. The sintering temperature is 800° C., and the sintering time is 5 hours.

Step 6: The sintered body obtained from the 5th step is hot-pressed. The hot pressing temperature is 800° C., the hot pressing pressure is 700 MPa, and the hot pressing time is 10 min.

Step 7: The hot-pressed body is hot-extruded. The hot extruding temperature is 900° C., the extruding ratio is 400, the extruding speed is 5 cm/min, and the preheating temperature of the extrusion mold is 500° C.

In this embodiment, the Ag-4ZnO-8$SnO_2$ material with obvious ZnO and $SnO_2$ fibrous reinforcing structures is finally obtained. The ZnO and $SnO_2$ fiber-like arrangements are respectively in the form of a number of directionally arranged and connected of many small ZnO and $SnO_2$ nano-particles. The obtained material has the tensile strength of 255 MPa, the resistivity along the extrusion direction of 2.3 μΩ·m, and the hardness of 89 HV.

Embodiment 5

Take the preparation of AgNi(25) contact material as an example

Step 1: 300 g reinforcing Ni powders (with an average particle size of 30 μm) are dissolved in 8 L aqueous solution containing 280 g hydrazine hydrate, and then the mixed solution is added into 12 L aqueous solution containing 800 g $AgNO_3$ with a stirring speed of 90 rev/min, and simultaneously ammonia is added to adjust the PH value of the solution to be 11 with the reaction time of 3 hours, the precipitation is filtered out, washed and dried at the drying temperature of 40° C. for 8 hours, thereby obtaining the composite powders with Ag coated reinforcing phase.

Step 2: The composite powders obtained from the $1^{st}$ step are granulated. The parameters can be set as below. The sintering temperature is 700° C. and the sintering time is 4 hours.

Step 3: The composite powders obtained from the $2^{nd}$ step are weighed, and the matrix silver powders are added into the composite powders according to the weight ratio which is 25% of Ni to the total weight, and then placed into the V-shaped powder mixer for uniformly mixing. The speed of the mixing machine is 30 rev/min and the time is 2 hours.

Step 4: The powders obtained from the $3^{rd}$ step are placed into a plastic tube with a diameter of 90 cm and a length of 150 cm for cold-isostatically pressing. The cold isostatic pressure is 200 MPa.

Step 5: The cold-isostatically pressed body obtained from the $4^{th}$ step is sintered. The sintering temperature is 600° C., and the sintering time is 7 hours.

Step 6: The sintered body obtained from the $5^{th}$ step is hot-pressed. The hot pressing temperature is 500° C., the hot pressing pressure is 500 MPa, and the hot pressing time is 20 min.

Step 7: The hot-pressed body is hot-extruded into sheets. The hot extruding temperature is 800° C., the extruding ratio is 225, the extruding speed is 10 cm/min, and the preheating temperature of the extrusion mold is 500° C.

In this embodiment, the AgNi(25) material with neat Ni fibrous reinforcing structure is finally obtained. The Ni fiber-like arrangement is in the form of a number of directionally arranged and connected small Ni particles. The obtained material has the tensile strength of 295 MPa, the resistivity along the extrusion direction of 1.95 μΩ·m, and the hardness of 80 HV.

Embodiment 6

Take the preparation of AgFe7 contact material as an example.

Step 1: 300 g reinforcing Fe powders (with an average particle size of 5 μm) are dissolved in 5 L aqueous solution containing 350 g hydrazine hydrate, and then the mixed solution is added into 15 L aqueous solution containing 1000 g $AgNO_3$ with a stirring speed of 120 rev/min, and simultaneously ammonia is added to adjust the PH value of the solution to be 8 with the reaction time of 10 hours, the precipitation is filtered out, washed and dried at the drying temperature of 100° C. for 8 hours, thereby obtaining the composite powders with Ag coated reinforcing phase.

Step 2: The composite powders obtained from the $1^{st}$ step are granulated. The parameters can be set as below. The sintering temperature is 700° C. and the sintering time is 2 hours.

Step 3: The composite powders obtained from the $2^{nd}$ step are weighed, and the matrix silver powders are added into the composite powders according to the weight ratio which is 7% of Fe to the total weight, and then placed into the V-shaped powder mixer for uniformly mixing. The speed of the mixing machine is 25 rev/min and the time is 2 hours.

Step 4: The powders obtained from the $3^{rd}$ step are placed into a plastic tube with a diameter of 90 cm and a length of 150 cm for cold-isostatical pressing. The cold isostatic pressure is 500 MPa.

Step 5: The cold-isostatically pressed body obtained from the $4^{th}$ step is sintered. The sintering temperature is 600° C., and the sintering time is 5 hours at the protection of $H_2$.

Step 6: The sintered body obtained from the 5th step is hot-pressed. The hot pressing temperature is 800° C., the hot pressing pressure is 300 MPa, and the hot pressing time is 20 min.

Step 7: The hot-pressed body is hot-extruded into sheets. The hot extruding temperature is 700° C., the extruding ratio is 200, the extruding speed is 10 cm/min, and the preheating temperature of the extrusion mold is 400° C.

In this embodiment, the AgFe7 material with neat Fe fibrous reinforcing structure is finally obtained. The Fe fiber-like arrangement is in the form of a number of directionally arranged and connected Fe nano-particles. The obtained material has the tensile strength of 320 MPa, the resistivity along the extrusion direction of 1.85 μΩ·m and the hardness of 79 HV.

It should be understood that the embodiments presented above can only be taken as examples of the invention and are not intended to represent any restrictions for or limitations to the technical scope of the present invention. The present invention can be applied to the preparation of other Agbased oxide contact materials with directionally arranged reinforcing particles by different composition ratio. Any modification within the principles of the present invention, equivalent replacement, and improvement shall be included within the scope of protection of the present invention.

What is claimed is:

1. A method of preparing silver-based electrical contact materials with directionally arranged reinforcing particles comprising steps of:

(A) dissolving reinforcing powders in hydrazine hydrate solution to form a mixed solution, adding the mixed solution into $AgNO_3$ solution for stirring, simultaneously adding ammonia for adjusting a PH value of the $AgNO_3$ solution which forms precipitates through a reaction, filtering out precipitation following the reaction, and washing and drying the filtered precipitation, thereby obtaining composite powders with Ag coating on the reinforcing phase, wherein a weight ratio of the reinforcing phase to $AgNO_3$ is calculated according to a content of the material needed, and a weight ratio of the hydrazine hydrate to $AgNO_3$ is calculated according to Ag on reduced by the hydrazine hydrate;

(B) granulating the composite powders obtained from the step (A);

(C) placing the composite powders obtained from the step (B) and silver powders into a powder mixer for mixing, wherein a weight ratio of the composite powders to the silver powders is calculated according to the content of the preparation material needed;

(D) cold-isostatically pressing the composite and silver powders obtained from the step (C);

(E) sintering the cold-isostatically pressed body to form a sintered body;

(F) hot-pressing the sintered body to form a hot-pressed body; and (G) hot-extruding the hot-pressed body, wherein during the hot-extrusion process, the composite powders with Ag coating on the reinforcing phase flow with softened Ag in the silver powders, due to coating of Ag, the reinforcing powders are easily open, and directionally arranged along an extrusion direction for forming a fibrous structure, thereby obtaining the silver-based electrical contract material with directionally arranged reinforcing particles, wherein in the step (A), a weight ratio of the reinforcing powders to $AgNO_3$ is 1/4-10/3; a weight ratio of the hydrazine hydrate to $AgNO_3$ is 2/3-1/3; a stirring speed is 80rev/min-120rev/min; an adjusted PH value after adding the ammonia is 8-11; a reaction time is 3-10 hours; a drying temperature is 40-100° C.; and a drying time is 5-10 hours.

2. The method of preparing silver-based electrical contract materials with directionally arranged reinforcing particles according to claim 1, wherein in the step (E) a sintering temperature is 400-800° C., and a sintering time is 2-6 hours.

3. The method of preparing silver-based electrical contract materials with directionally arranged reinforcing particles according to claim 2, wherein in the step (C), a speed of the powder mixer is 20 rev/min-30 rev/min, and a mixing time is 2-4 hours.

4. The method of preparing silver-based electrical contract materials with directionally arranged reinforcing particles according to claim 3, wherein in the step (D), a cold isostatic pressure is 100-500 MPa.

5. The method of preparing silver-based electrical contract materials with directionally arranged reinforcing particles according to claim 4, wherein in the step (E), a sintering temperature is 600-800° C., and a sintering time is 5-9 hours.

6. The method of preparing silver-based electrical contract materials with directionally arranged reinforcing particles according to claim 5, wherein in the step (F), a hot-pressing temperature is 500-800° C., a hot-pressing pressure is 300-700 MPa, and a hot-pressing time is 1 min-20 min.

7. The method of preparing silver based electrical contract materials with directionally arranged reinforcing particles according to claim 6, wherein in the step (G), a heating temperature of the body is 600-900° C., in the extrusion an extruding ratio is 100-400, an extruding speed is 5-20 cm/min, and a pre-heating temperature of an extrusion mold is 300-500° C.

8. The method of preparing silver-based electrical contract materials with directionally arranged reinforcing particles, according to claim 7, wherein for the silver-based electrical contract material with directionally arranged reinforcing particles, the reinforcing phase exists in the silver powders in the step (C) in a form of particles connecting with each other and being directionally arranged, an average size of the reinforcing particles is 50 nm-30 pm.

* * * * *